United States Patent [19]

Klawitter

[11] Patent Number: 4,779,763

[45] Date of Patent: Oct. 25, 1988

[54] TWO-CHAMBER CONTAINER

[75] Inventor: Hans-Jorg Klawitter, Munich, Fed. Rep. of Germany

[73] Assignee: F.P.D. Future Patents Development Company, S.A., Luxembourg, Luxembourg

[21] Appl. No.: 88,509

[22] Filed: Aug. 20, 1987

Related U.S. Application Data

[63] Continuation of Ser. No. 830,575, Feb. 18, 1986, abandoned, which is a continuation-in-part of Ser. No. 550,649, filed as PCT DE82/00217 on Nov. 15, 1982, published as WO83/01936 on Jun. 9, 1983, abandoned.

[51] Int. Cl.[4] ..... B67B 7/24

[52] U.S. Cl. ..... 222/80; 222/82; 222/136; 222/402.22; 206/219

[58] Field of Search ..... 222/80, 135, 136, 402.21, 222/402.23, 402.24, 145, 325, 82; 169/85, 88; 239/304, 307, 308; 206/219, 222

[56] References Cited

U.S. PATENT DOCUMENTS

| | | | |
|---|---|---|---|
| 3,454,198 | 7/1969 | Flynn | 222/402.23 |
| 3,961,669 | 6/1976 | Kaneko | 222/80 |
| 4,203,534 | 5/1980 | Finke | 222/402.21 |
| 4,361,253 | 11/1982 | Flynn et al. | 222/325 |
| 4,469,252 | 9/1984 | Obrist | 222/399 |
| 4,666,062 | 5/1987 | Pershall | 222/399 |

FOREIGN PATENT DOCUMENTS

| | | | |
|---|---|---|---|
| 2532562 | 2/1977 | Fed. Rep. of Germany | 169/88 |
| 283237 | 3/1931 | Italy | 169/88 |
| 618056 | 2/1961 | Italy | 169/88 |

*Primary Examiner*—H. Grant Skaggs
*Attorney, Agent, or Firm*—Lorusso & Loud

[57] ABSTRACT

A two-chamber container for two gas-pressurized components kept separately, for example liquids which are miscible. An outer chamber contains a first component and is provided with a dispensing valve whose interposed connecting member leads from the interior of the outer chamber to the outside and is adapted to be closed by a plug. The second component is contained in an inner chamber mounted in the interior of the outer chamber. The inner chamber is an entirely separate, self-contained vessel supported in the interior of the outer chamber. The interior end of the interposed connecting member terminates in a cup-shaped receptor member which is disposed above and around the distal end portion of the inner chamber such that a radial and axial clearance of 1–2 mm between the receptor member and the distal end is provided. The inner chamber has a desired rupture site which can be broken by force from outside, for example by pivoting or pushing-in the dispensing valve. In this manner ready communication is established between the interiors of the two containers so that spontaneously complete mixing of the two components is achieved.

19 Claims, 12 Drawing Sheets

TWO-CHAMBER CONTAINER

CROSS REFERENCE TO RELATED APPLICATION

This application is a continuation of applicant's patent application Ser. No. 830,575 filed on Feb. 18, 1986 (now abandoned) which is a continuation-in-part of patent application Ser. No. 550,649 entitled, "A Two-Chamber Container," filed as PCT DE82/00217 on Nov. 15, 1982, published as WO83/01936 on Jun. 9, 1983 (now abandoned), the teachings of which are incorporated herein by reference.

BACKGROUND OF THE INVENTION

The invention relates to a two-chamber container for two gas-pressurized components kept separately in a container, such as liquids reacting or being miscible with each other. The assembly consists of an outer chamber which receives a first component, a dispensing valve which seals the outer chamber and includes an interposed connecting member for communication between the component mixture and the outside, an inner chamber which is housed in the outer chamber and receives a second component, and a receptor member responsive to the selective movement of the interposed connecting member which enables accident free transport of the container, filling of the outer chamber subsequent to insertion of the inner chamber, and spontaneous mixing of the two components through rupture of the inner chamber.

Two-chamber containers are known from British Pat. No. 1,482,468, issued to Robert Harold Laauwe, entitled "Aerosol Valve Assembly". In that arrangement the outer chamber receives a first component, while a second component is received in a bag-like inner chamber within the outer chamber. By actuating the valve both components pass through narrow channels into a mixing chamber in which they may mix or react with each other and are then discharged through an outlet channel. One disadvantage of this arrangement is that the mixing of the two components in the mixing area of the valve is insufficient. Another shortcoming of such a two-chamber container resides in the fact that one component is received in a bag-like inner chamber which inherently has a certain permeability so that with longer periods of storage there is the risk that the material will penetrate prematurely from the inner chamber into the outer chamber. This causes special problems if the substances are corrosive.

Another two-chamber package is disclosed in European patent publication No. 24 659, issued to Aerosol-Service AG, entitled "Zweikammerpackung". In this case a piston is provided in the inner chamber. The displacement of the piston, however, is indirect, being caused by pressure conditions which become established in the outer chamber and in the inner chamber. Problems occur if either pressure does not attain the values necessary for displacement of the piston. Furthermore if clamping of the piston in the inner chamber occurs, functioning of the entire arrangement is impaired. Finally, leakages during longer periods of storage are unavoidable since the inner chamber itself is not a self-contained vessel. In addition, the valve assembly is a very complicated structure and the pressure ratios must be established in the interior of the outer chamber.

SUMMARY OF THE INVENTION

The present invention is a two-chamber container for safely storing, and selectively mixing, gas pressurized miscible liquids. The assembly consists of an outer chamber which contains a first component and an inner chamber, mounted within the outer chamber, which contains a second component. A dispensing valve seals the first component within the outer chamber and further includes an interposed connecting member through which selective communications between the interior of the outer chamber and the outside environment is maintained. The outer chamber interior end of the interposed connecting member terminates in a cup-shaped receptor member which is disposed above and around the distal end portion of the inner chamber. Pivoting or displacing the dispensing valve with respect to the outer chamber results in the receptor member engaging, and eventually fracturing, the desired rupture site. This embodiment is especially advantageous since it guarantees the opening of the inner chamber regardless of the magnitude of the pressure conditions existing inside the outer chamber.

In one important embodiment of the invention there is a radial clearance of 1–2 mm between the receptor member circumferential walls and the outer periphery of the inner chamber neck portion. Additionally, an axial clearance of 1–2 mm exists between the top of the neck portion and the receptor member inner face. By providing these axial and radial clearances a significant amount of jostling may occur during transport without premature fracture of the inner chamber. The radial clearance additionally enables the filling of the outer chamber after the inner chamber has been assembled within the outer chamber and the outer chamber has been sealed. This operation is accomplished by pivoting the dispensing valve to the extent enabled by the radial clearance of the receptor member, thereby exposing the lateral openings along the interposed connecting member and establishing communication with the outer chamber interior. The inner chamber neck does not engage to the receptor member, and hence cannot be fractured, unless the dispensing valve is further pivoted so that its lateral movement exceeds the radial clearance provided. A propellant or other fluid is introduced into the outer chamber through the interposed connecting member to the extent necessary to sufficiently pressurize the two-chamber container. Returning the dispensing valve to its original position terminates communication between the interposed connecting member and the outer chamber interior, sealing the two chamber container until mixing of the liquids is required.

It may alternatively be advantageous to design the receptor member as a crushing tip which pierces the inner chamber at a predetermined location. In this embodiment, an axial and radial clearance of 1–2 mm is again provided in order to ensure against accidental fracture of the inner chamber during transport as well as to allow filling of the outer chamber with a propellant or other fluid subsequent to installation of the inner chamber within the assembly.

The inner chamber is an entirely independent, self-contained vessel which is supported in the interior of the outer chamber. A desired rupture site is selectively fractured from the outside, thereby establishing a large medium for communication with the interior of the outer chamber. Spontaneous and substantially complete mixing of the components ensues, with the resulting mixture being dischargeable through the dispensing valve.

By design there is no communication between the inner chamber and either the dispensing valve or the other chamber while the components are being stored. This embodiment is particularly important for applications involving highly corrosive substances where avoidance of any premature reaction of the components is required to prevent chemical attack of the outer chamber walls (e.g. highly corrosive hair dyes). Optimum mixing of the components is then guaranteed by the large medium for communication established between the interior of the outer chamber and the fractured rupture site of the inner chamber.

The inner chamber is preferably embodied by a fragile ampoule made of glass, ceramics, plastics or the like, which is mounted within the outer chamber and is supported in the upper and, or alternatively, in the lower range of its body. The desired rupture site is provided at either the neck portion, which may be constricted if desired, or at the bottom of the inner chamber. Regardless of its location, the rupture site is formed by an area of reduced wall thickness which always guarantees spontaneous mixing of the components as soon as the desired rupture site has been broken.

Of course, the inner chamber is designed to be pressure-resistant and is fully sealed to take up the second component and, if desired, a pressure gas. The outer chamber, on the other hand, contains the first component and consists of a pressure-resistant can of metal or plastics.

In another embodiment, the inner chamber is sealed by an integrally formed closure plunger having an outwardly projecting pressure or tilting pin which is disposed within, and surrounded by, the receptor member. In this structure there is no loose intermediate member between the dispensing valve and the inner chamber. Instead, the dispensing valve acts directly by the closure plunger on the inner chamber. Simply pressing and/or tilting the dispensing valve beyond the 1–2 mm radial or axial clearance displaces the closure plunger out of its sealing position. Preferably, the desired rupture site is defined by an annular seal which is adapted to be torn or broken out of an annular locking groove, but otherwise retains the closure plunger in sealing fashion in the corresponding opening of the inner chamber. This desired rupture site may be broken easily by acting directly on the closure plunger.

It is especially advantageous if the closure plunger constitutes an integral component part of the inner chamber. In this embodiment the desired rupture site is formed by an annular notch or the like. Alternatively, the closure plunger is an integral part of a lid which is fixed to the opening of the inner chamber by welding, fusing, gluing, crimping, or the like.

An annular shoulder of the inner chamber may support the closure plunger, which shoulder is supported in the outer chamber and receives the annular seal adapted to be broken. Thus the annular shoulder becomes an effective thrust bearing when the desired rupture site is broken by mechanical activation of the dispensing valve.

It is, therefore, an object of the invention to provide a two-chamber container which guarantees safe, separate storing of different components even during extended periods of storage and, furthermore, allows good mixing of the two components when the two-chamber container is put to use.

It is a further object of the present invention to provide a two-chamber container which minimizes damage to the inner chamber during transport and which enables filling of the outer chamber subsequent both to the insertion of the inner chamber and the sealing of the outer chamber.

BRIEF DESCRIPTION OF THE DRAWING

The invention will be described further, by way of example, with reference to the accompanying drawings, in which.

DESCRIPTION OF THE PREFERRED EMBODIMENTS

Figure 1A:
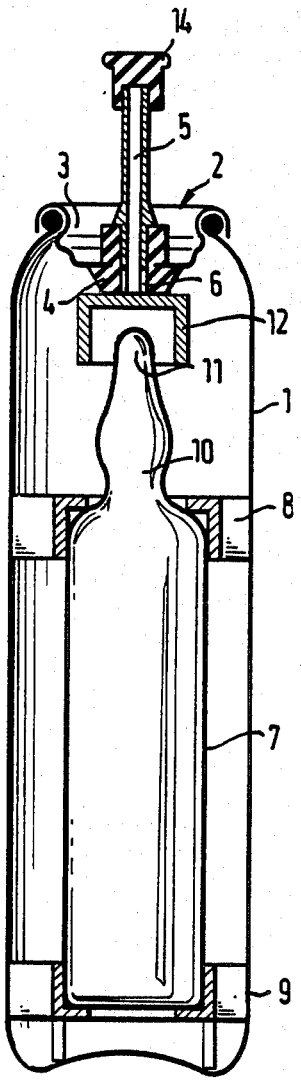
FIGS. 1*a*, 1*b* and 1*c* show a first embodiment of a two-chamber container according to the invention, the breaking being effected by tilting or pivoting movement of the dispensing valve sufficiently beyond the radial clearance.

At the outset, the invention is described in its broadest overall aspects, with a more detailed description following. This invention relates to a two-chamber container for storing and selectively dispensing separately contained components.

The invention comprises a pressure-resistant outer chamber 1 of metal or the like having a dispensing valve 2 inserted in its upper opening and arranged in a known manner in an upper cover of the outer chamber 1. The dispensing valve 2 includes an elastic sealing collar 4 and an interposed connecting member 5 closed at the top by a plug 14 and having lateral openings 6 at the lower side, through which fluid communication in reversible direction, either filling or dispensing, is established between the interposed connecting member and the interior of the outer chamber 1.

An inner chamber 7 is mounted in the center of the outer chamber 1 interior by supports 8 and 9. The inner chamber 7 is surrounded at its outside by the one component, while the other component is received in its interior. The inner chamber 7 is an entirely separate, self-contained vessel. There is absolutely no communication between the inner chamber and the dispensing valve 2 or the interior of the outer chamber 1, when the two chamber container is being used to store the two components as shown in FIG. 1*a*.

In the preferred embodiment, the inner chamber 7 is an ampoule made of either glass, ceramics, china, or any other hard, fragile material, which is centered by the supports 8 and 9 and held in a safe manner, to protect against breakage. A suitable selection of material for this purpose allows the supports 8, 9 to be designed as shock absorbers. Alternatively, the supports may include radially extending webs which are uniformly spaced along the circumference of the inner chamber, and which are maintained against and between the inner chamber and outer chamber by centering rings. Such an arrangement provides enhanced support of the inner chamber within the outer chamber thereby facilitating selective fracture of the inner chamber, while conversely preventing premature breakage during transport.

The lateral extension of the dispensing valve 2 terminates into a cup-shaped receptor member 12 disposed relative to the inner chamber head 11. It is integral that the cup-shaped receptor member 12 have clearance of 1–2 mm in the axial and radial direction with respect to the inner chamber head 11. This embodiment enables both the damage free transport of the two chamber container as well as the unimpeded filling of the outer chamber subsequent to assembly of the inner chamber within the outer chamber. Conveniently, the head 11 of the inner chamber 7 is adapted to the shape of the cup-shaped receptor member 12 to guarantee good engagement upon pivoting of the dispensing valve 2 beyond the provided clearance.

Prior to selective mixing of the two components, the first liquid is housed in the space between the inner chamber 7 and the wall of the outer chamber 1, while the second liquid is housed in the interior of the inner chamber 7. Either the inner chamber or the outer chamber may contain the driving agent or pressurized gas.

Figure 1B:
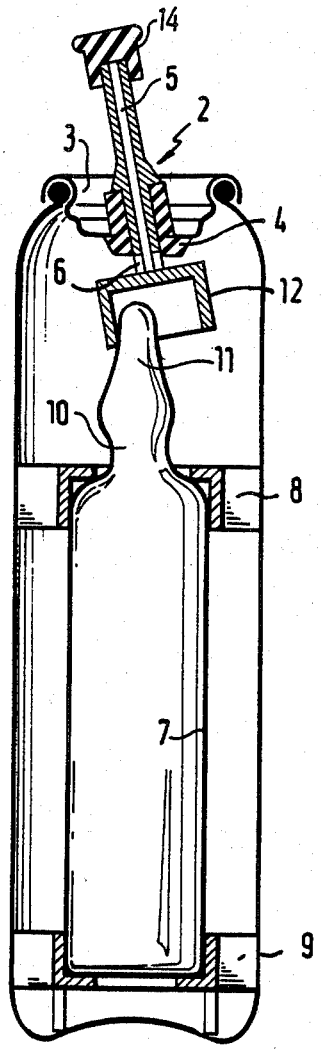

The outer chamber component may be introduced through the interposed connecting member 5 subsequent to the final assembly of the two chamber container, as is shown in FIG. 1*b*. Pivoting the dispensing valve 2 exposes the lateral opening 6 originally covered by the elastic sealing collar 4 so that an external fluid introduced through the interposed connecting member communicates with the interior of the outer chamber 1. Positioning the cup-shaped receptor member 12 above and around the distal end to effect an axial and radial clearance of 1–2 mm enables the pivoting of the dispensing valve 2 without damaging the inner chamber neck 11. Thus, it is crucial both that the inner diameter of the receptor member 12 be 1–2 mm larger than the distal end 11 outer diameter and that there be an axial distance of 1–2 mm between the top of the distal end 11 and the inner face of the cup-shaped receptor member 12. Absent these specific tolerances, the receptor member would be continuously engaged to the distal end and would therefore fracture the distal end in response to the pivoting of the dispensing valve during the outer chamber filling process.

The first embodiment is seen to have a desired rupture site 10 defined by a constricted neck portion of the head 11 of the inner chamber 7. Tilting or pivoting the dispensing valve 2 beyond the specified 1–2 mm clearance, according to FIG. 1*c*, will break this desired rupture site 10. The breaking is permitted by the elastic sealing collar 4. The components are then mixed and activated spontaneously. The mixing of the two components may also be promoted by shaking. The plug 14 seals the interposed connecting member 5 during the tilting movement in order to prevent premature ejection of the fluids. After mixing and activating, the mixed product may be discharged by actuating the dispensing valve without the plug 14. Corresponding means (not shown) are provided at the interposed connecting member 5 for actuating the dispensing valve. These means allow the interposed connecting member 5 to be moved far enough into the interior of the outer chamber 1 to guarantee fluid communication between the interior of the container and the outside environment. Movement of the interposed connecting member into the interior of the container is effected in a known manner against the action of an elastic element, such as a helical spring or, as in the case shown, against the action of the elastic sealing collar 4.

Figure 2A:
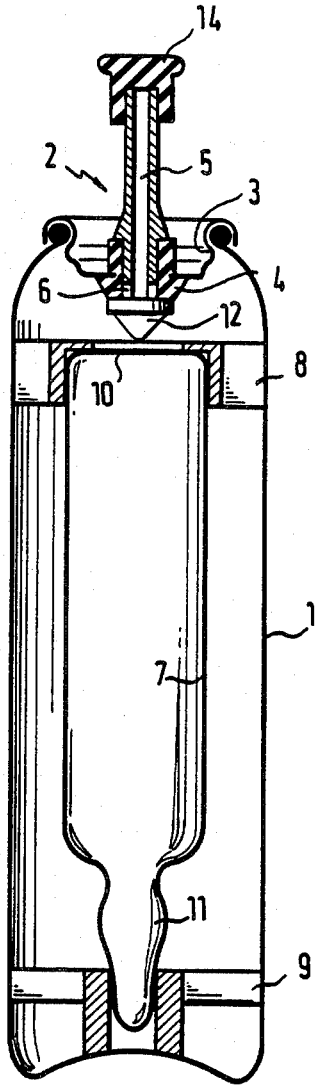
FIGS. 2*a*, 2*b* and 2*c* show a second embodiment of the two-chamber container according to the invention, the breaking of the inner chamber being effected by pressing the dispensing valve past the axial clearance provided.
Figure 2B:
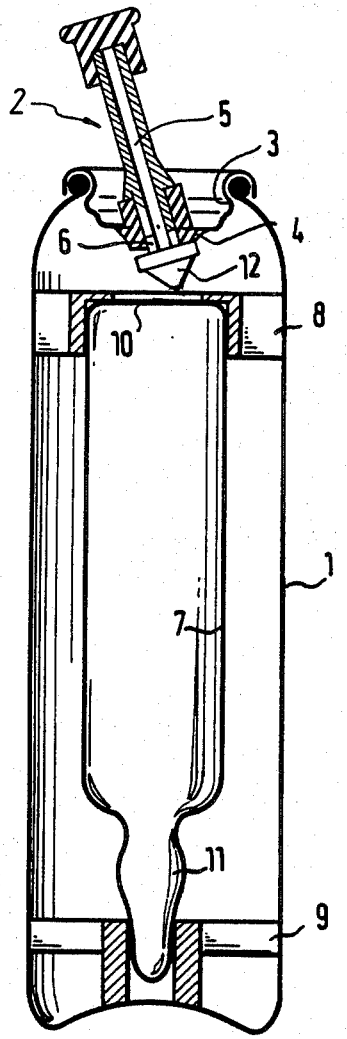
Figure 2C:
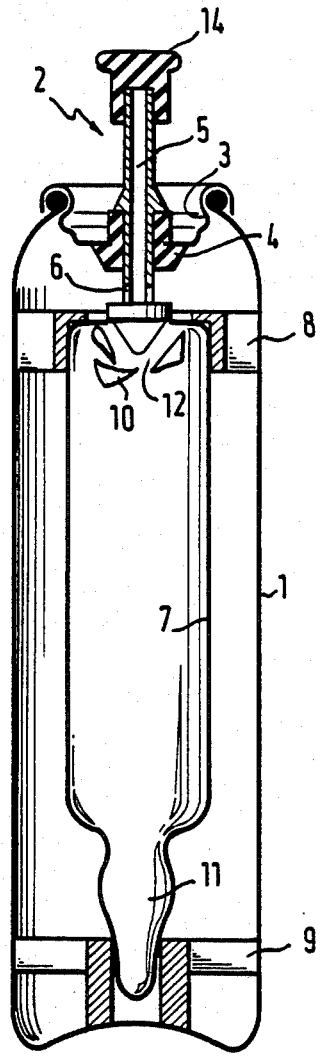

In FIGS. 2*a*–2*c* the inner chamber 7 is housed upside down on its head 11 in the interior of the outer chamber 1. In this embodiment, the dispensing valve 2 is provided with a tip shaped receptor member 12 for breaking or piercing the desired rupture site 10 at the bottom of the inner chamber 7. Hence, the inner chamber 7 is broken by pushing in, rather than tilting, the dispensing valve 2. The tip shaped receptor member 12*a* is disposed 1–2 mm axially from the rupture site in order to protect against accidental piercing of the bottom portion during packaging as well as to facilitate filling of the outer chamber subsequent to complete assembly.

The two embodiments described above are provided with the same reference numerals so that any detailed explanation of members already identified by corresponding reference numerals may be dispensed with. In both cases the inner chamber 7 is supported in the vicinity of the predetermined rupture site 10 so that the inner chamber cannot yield when the dispensing valve 2 is actuated in order to break the desired rupture site. It obviously makes no difference if the head 11 of the inner chamber 7 breaks off when the dispensing valve 2 is actuated in order to open the inner chamber.

Figure 1C:
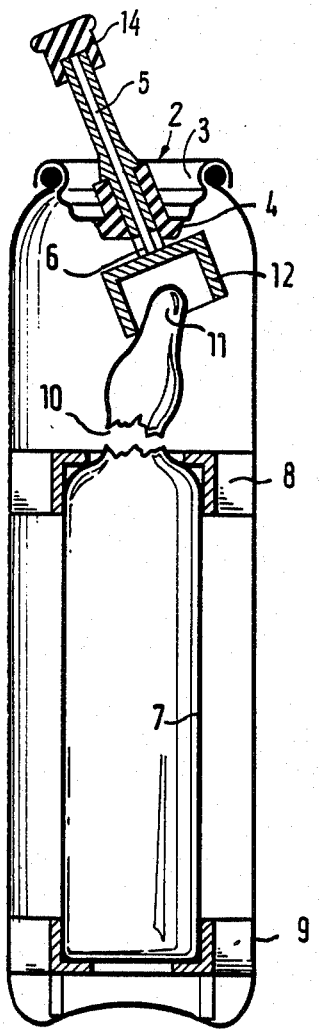
Figure 3A:
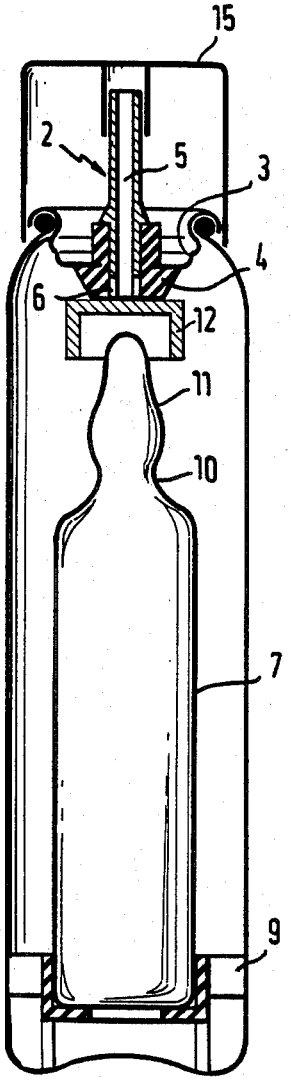
FIGS. 3*a*, 3*b* and 3*c* show a third embodiment of the two-chamber container according to the invention, the breaking of the inner chamber being effected by impact carried out laterally subsequent to axial movement of the dispensing valve beyond the provided clearance.
Figure 3B:
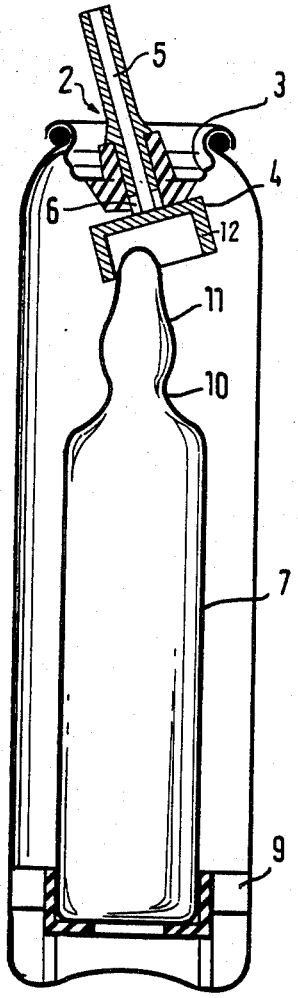
Figure 3C:
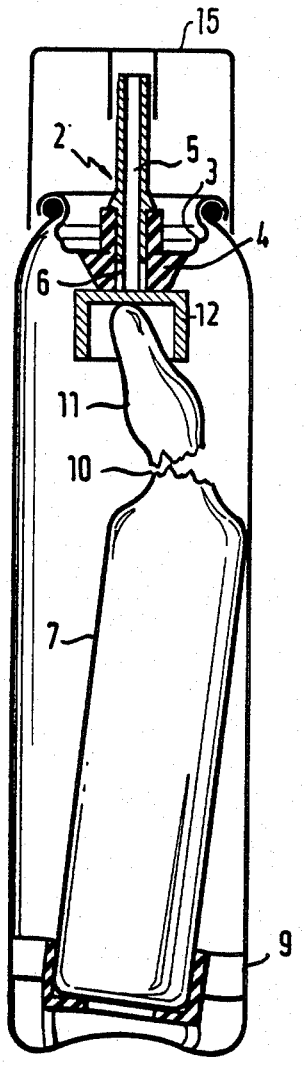

The third embodiment shown in FIGS. 3*a*–3*c* makes use of an arrangement similar to the embodiment shown in FIGS. 1*a*–1*c*. Other than in the case of the first embodiment, however, a single support 9 is provided only in the lower range of the ampoule. Additionally, a cap 15 is provided in the upper range to hold the dispensing valve 2 conveniently in engagement with the interposed connecting member 5. In this case the inner chamber 7 is broken at the desired rupture site 10 by lateral impact against the two-chamber container. The cup-shaped receptor member lower portion 12, into which the head 11 of the inner chamber 7 is ultimately received, retains the head so that the inner chamber 7 may tilt and break upon axial movement beyond the 1–2 mm clearance as shown in FIG. 3*c*.

Another embodiment may be taken from FIGS. 4*a* to 4*g*. The inner chamber 7 in this case is made of plastics such as, polystyrene, polycarbonate, polyacetate, or of metal, and fixed in the outer chamber 1 by supports 8 and 9, which preferably are retaining rings. The second component is sealed within the inner chamber 7 by lid 16 which is connected by welding 17 to the inner chamber 7. If desired, the lid 16 may alternatively be formed integrally with the inner chamber 7. The lid 16 has a central portion 19 connected by a notch 18 to the remainder of the lid 16. A pin 20 projects upwardly from the central portion 19 of the lid 16 and may be connected in addition by reinforcements with the central portion 19. In such an arrangement, the central portion 19 and the pin 20 combine to form a closure plunger.

Figure 4A:
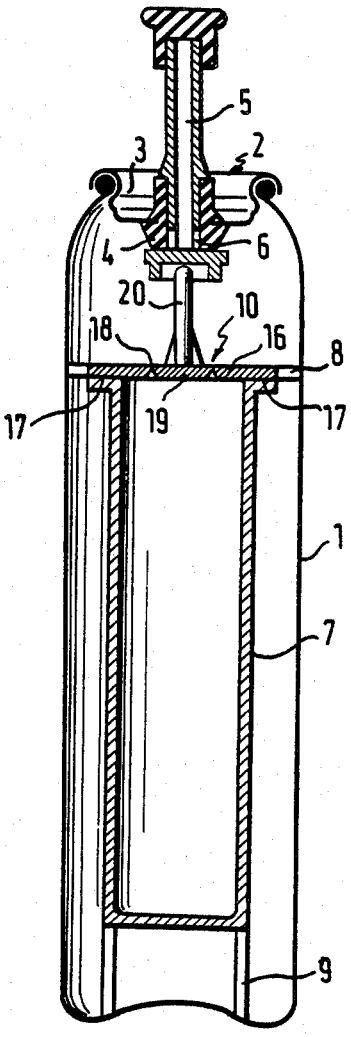
FIGS. 4*a*–4*g* show a fourth embodiment of the two-chamber container according to the invention, the breaking of the inner chamber being effected by pushing in the dispensing valve to an extent sufficient to exceed the axial clearance.
Figure 4B:
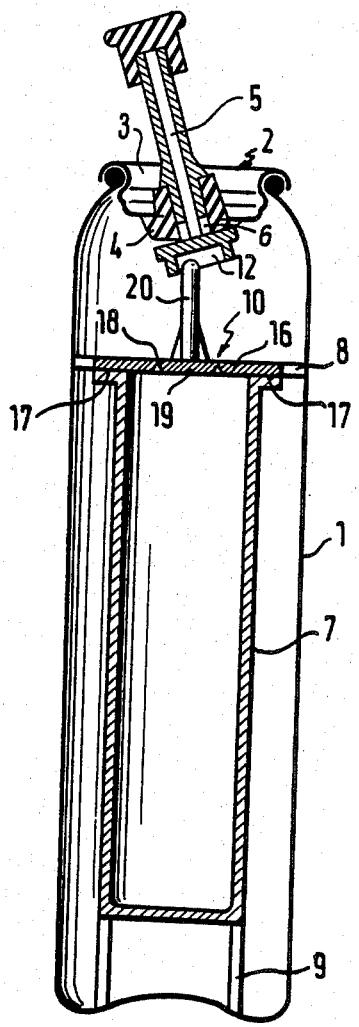

The pin 20 is positioned relative to the cup-shaped receptor member 12 of the dispensing valve 2. The pin 20 is not in direct contact with the receptor member 12 but, instead, is disposed within and surrounded by the cup-shaped interior side faces in such a manner that a radial and axial clearance between 1–2 mm exists between the receptor member 12 and the pin 20. Such an embodiment enables direct attack of the dispensing valve 2 on the inner chamber 7, while conversely preventing accidental mixing of the components during transport. As seen in FIGS. 4*a* and 4*b*, the desired rupture site is defined by an annular notch 18. In other embodiments (not shown), the desired rupture site may be formed by a surface area of reduced wall thickness adapted to be broken by the action of force.

Figure 4C:
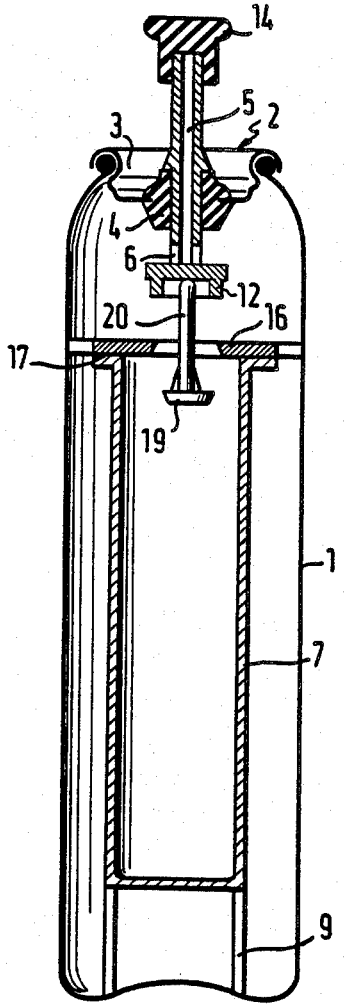
Figure 4D:
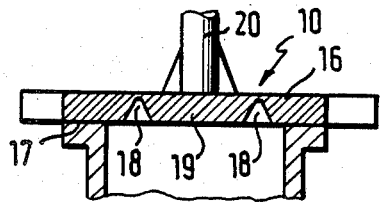
Figure 4E:
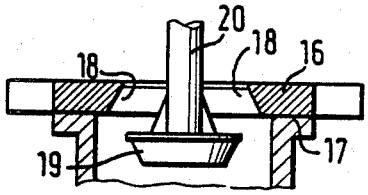

As shown in FIGS. 4*c* and 4*e*, the desired rupture site 10 may be opened by pushing the dispensing valve 2 or the interposed connecting member 5 into the interior of the inner chamber. The broken parts of the lid 16 will fall into the inner chamber 7 as the plunger formed by the central portion 19 and the pin 20 is pressed into the inner chamber 7.

Figure 4F:
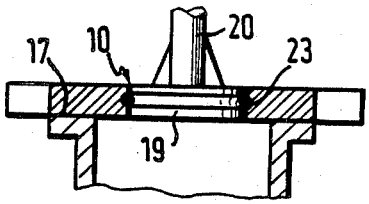
Figure 4G:
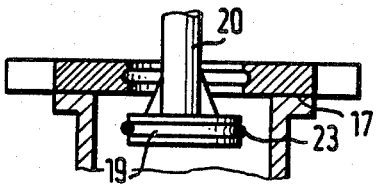
Figure 5A:
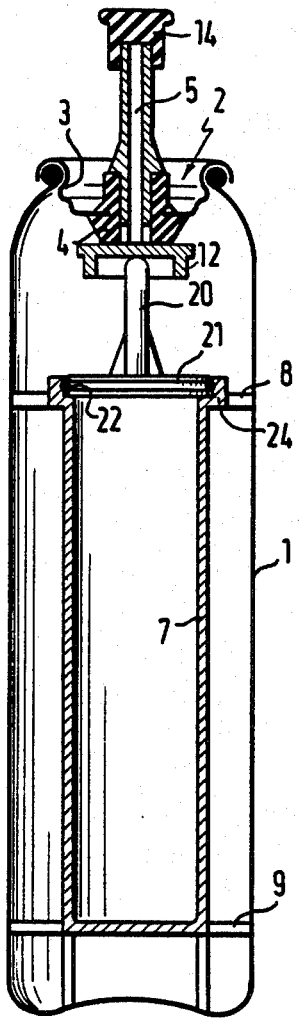
FIGS. 5*a*–5*d* show a fifth embodiment of the two-chamber container according to the invention, the opening of the inner chamber being effected by tilting or pivoting movement of the dispensing valve sufficiently beyond the radial clearance.
Figure 5B:
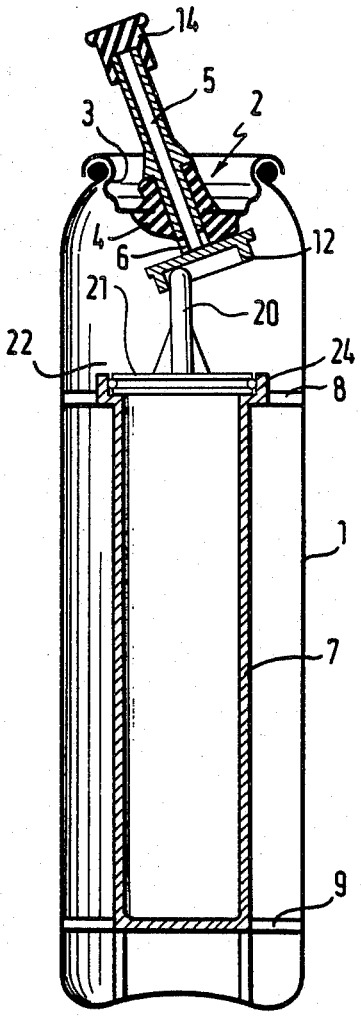
Figure 5D:
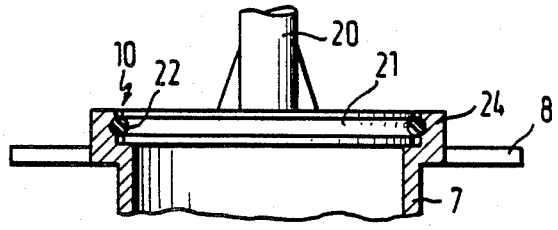
Figure 5C:
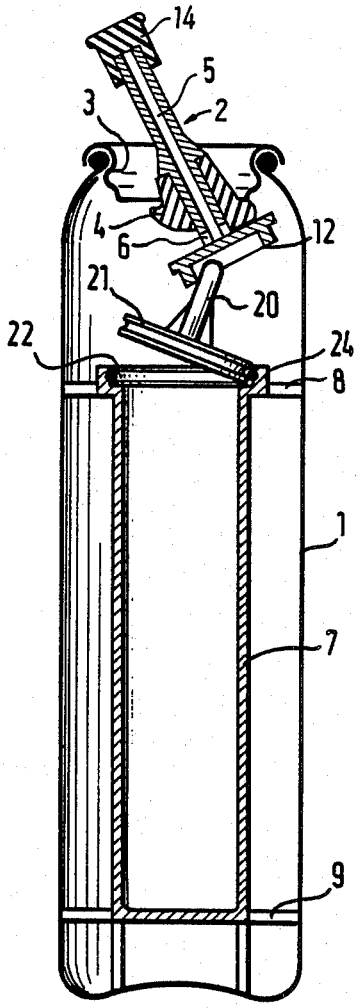

FIGS. 4*f* and 4*g* are diagrammatic presentations of yet another embodiment in which the desired rupture site is formed by an annular seal 23, preferably an O-ring, formed between a take-up groove in the lid 16 and the central portion 19. The central portion 19 is easily broken out of its retaining groove by pushing in the pressure pin 20.

Another embodiment similar to that shown in FIGS. 4*f* and 4*g* is illustrated in FIGS. 5*a* to 5*d*. In this embodiment however, the closure plunger consisting of the pin 20 and the lid 21 is not pushed in. Instead, the lid 21 is supported by an annular shoulder 24 through intermission of an annular seal 22 and the inner chamber 7 held by the support 8.

In a manner similar to the embodiment shown in FIGS. 1*a*–1*c*, the dispensing valve 2 and the interposed connecting member 5 are tilted beyond the 1–2 mm radial tolerance to enable communication between the inner and outer chambers. In response to this movement, the cup-shaped receptor member 12, disposed above and around the pin 20, rotates or tilts the plunger with respect to the annular shoulder 24, as shown most clearly in FIG. 5*b*.

The same materials used for the inner chamber and the outer chamber of the embodiments which were described earlier may also be employed in the embodiment shown in FIGS. 5*a* to 5*d*. It is again imperative, of course, that the inner chamber remain tightly sealed, especially in the area of the annular shoulder 24. Only this area need be made of fragile material so as to define the desired rupture site. As is obvious to those skilled in the art, the inner chamber 7 may be designed to include one piece or two pieces, the latter case being provided with a corresponding tight weld.

Maintaining a tight seal around the mouth of the inner chamber guarantees that a component may be received safely in the inner chamber for an indefinite period of storage. This is particularly important for storing corrosive and aggressive components. Breaking of the desired rupture site then provides for good mixing and activation of the overall contents of the two-chamber container for the desired purpose.

Certain embodiments involving large inner chambers require additional means of support. To compensate for the increased dimensions or weight of a large inner chamber, a tubular or sleeve-like insert or a centering sleeve 24' is introduced into the outer chamber 1 prior to the introduction of the inner chamber 7. The sleeve 24' is centered in the outer chamber 1 by a centering shoulder 25 extending from the lower portion of the closure cap 3. The assembly of this embodiment of the two-chamber container involves first inserting the sleeve 24' into the outer chamber 1 into which the inner chamber 7 is then introduced. Finally the closure cap 3 together with the dispensing valve 2 is applied. The mutual centering of sleeve 24' and cap 3 by the centering shoulder 25 guarantees that the lower portion 12 of the dispensing valve 2 will be positioned directly above and around the head 11 of the inner chamber so that an axial and radial clearance of 1–2 mm is provided.

The radial clearance of 1–2 mm additionally enables the filling of the outer chamber 1 through the interposed connecting member 5 after the inner chamber 7 has been assembled within the sleeve 24' and the outer chamber 1 has been sealed. Pivoting the dispensing valve 2 exposes the lateral openings 6 at the lower side of the interposed connecting member 5 through which communication between the outer chamber and fluid to be introduced is established. Since the receptor member 12 is positioned around and over the distal end 11 of the neck portion, rather than in direct engagement thereto, the dispensing valve 2 may be pivoted sufficiently to expose the lateral openings 6 of the interposed connecting member 5 without necessitating engagement of the receptor member 12 to the distal end 11, thereby avoiding premature fracture of the inner chamber 7. Return of the dispensing valve 2 to its outer chamber sealing position terminates the communication between the interposed connecting member 5 and the outer chamber 1 interior, sealing the two-chamber container until its application is required.

The centering sleeve 24' is, of course, provided especially in the area of the desired rupture site, with sufficiently large apertures so that spontaneous mixing of the components is enhanced upon opening of the inner chamber. Preferably, the sleeve 24' is made of a mesh tube.

Figure 6:
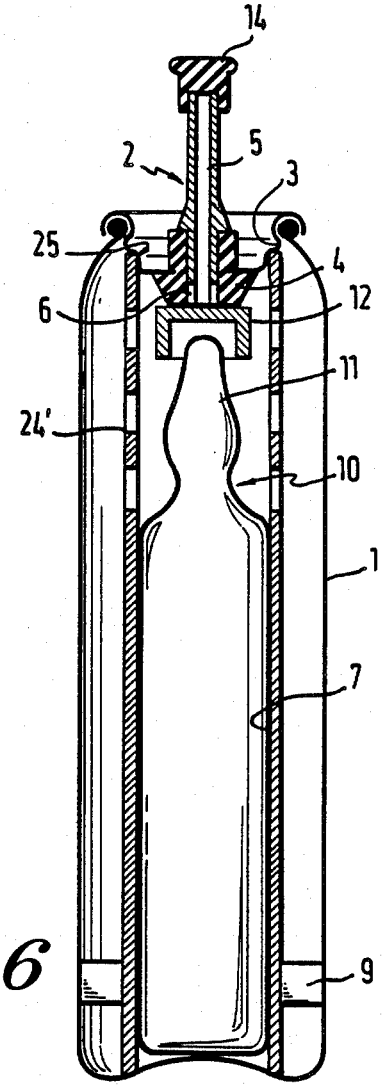
FIG. 6 shows a sixth embodiment of the two-chamber container according to the invention, the inner chamber being held in a centering sleeve.

In the embodiment shown in FIG. 6 the centering sleeve extends across the entire length of the outer chamber 1. However, it is sufficient for the sleeve to extend along only part of this length, provided that the inner chamber is held securely within the outer chamber. In the latter embodiment, the centering sleeve is attached firmly to the underside of the closure cap 3 of the outer chamber 1 by gluing or welding. Hence, the inner chamber 7 is introduced at the same time that the cap 3, and the sleeve fixed to the underside thereof, is applied.

Figure 7:
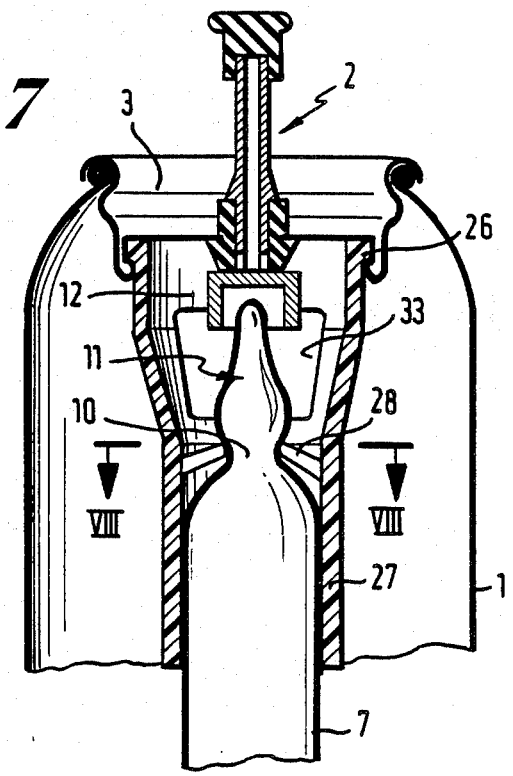
FIGS. 7 and 8 show a modified embodiment of a centering sleeve in longitudinal and cross sectional elevation, respectively.
Figure 8:
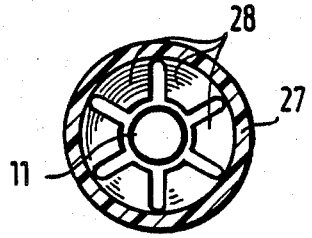

FIGS. 7 and 8 show a preferred embodiment for fixing the inner chamber 7 by means of a centering sleeve 27 firmly attached to the underside of the closure cap 3 of the outer chamber 1. This centering sleeve embraces only the upper portion or the portion of the inner chamber 7 facing the closure cap 3 and is made preferably of plastic material. It is fixed to the underside of the closure cap 3 by means of a crimping bead. Alternatively, it is also conceivable to make the closure cap 3 and the centering sleeve 27 in the form of a one piece plastic injection molded member.

In the preferred embodiment, three radially inwardly and obliquely upwardly directed support and catch lugs 28 are uniformly spaced along the periphery of the centering sleeve 27. Such an arrangement permits the head portion 11 of the inner chamber 7 to be pushed effortlessly from below through the upwardly directed lugs 28 and into the centering sleeve 27. The support and catch lugs 28 engage the fully pushed in inner chamber 7 in the area of the constricted neck portion defining the desired rupture site 10 of the inner chamber 7. The upward urging of the lugs 28 maintains the inner chamber 7 safely in the centering sleeve 27. The lugs 28 serve not only as catches cooperating with the constricted neck portion of the inner chamber 7 but also as a thrust bearing when the head 11 is broken off as shown in FIG. 1*b*. Windows or apertures 33 are uniformly spaced along the circumference of the centering sleeve 27 above the support and catch lugs 28 thereby ensuring spontaneous mixing upon opening of the inner chamber 7.

According to FIGS. 7 and 8 a unit is formed of the closure cap 3 and centering sleeve 27. In this embodiment, the inner chamber 7 is pushed headon from below until the support and catch lugs 28 have become engaged in the constricted neck portion in the area of the desired rupture site 10. The inner chamber 7 is thus held safely in the centering sleeve 27 without any further support. At the same time, the lugs 28 maintain the inner chamber's 7 proper location with respect to the cup-shaped receptor member 12. This embodiment does not require the support rings 8 and 9 according to FIGS. 1*a* to 2*c*. The inner chamber may be held safely within the outer chamber regardless of the dimensions of the latter.

Figure 9:
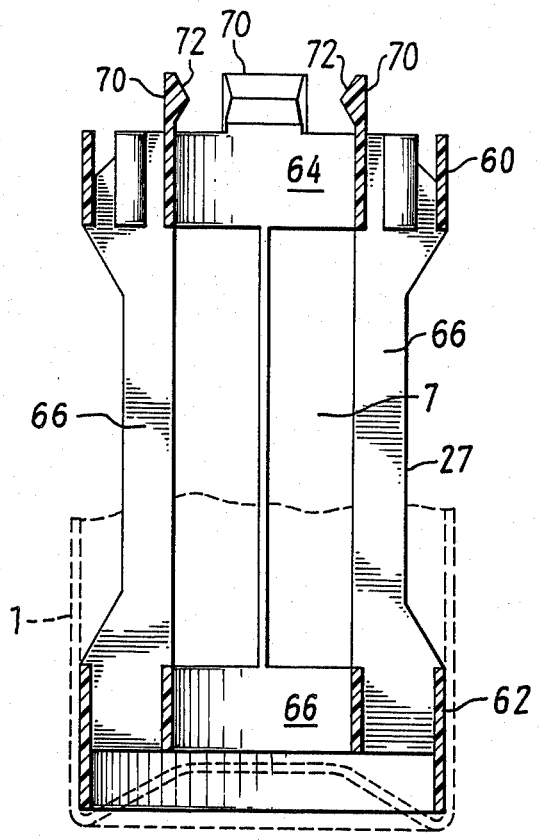
FIG. 9 shpows an alternative embodiment of a centering sleeve for holding and supporting the inner chamber within the outer chamber.

In an alternative embodiment, the centering sleeve 27 supports the inner chamber 7 only along its body portion, rather than along its entire length, as is illustrated in FIG. 9. Upper and lower support rings 60, 62 press fitted to the inner circumference of the outer chamber are connected to the periphery of the sleeve 27 by a plurality of uniformly disposed radially extending connecting webs 63. The connecting webs extend axially solely between the length of the support ring or alternatively they may extend along the entire length of the body portion to enable the same connecting web to connect both the upper and lower support rings to the centering sleeve. In the latter embodiment, two annular sleeve rings 64, 66 may be positioned relative to the upper and lower support rings 60, 62 so that the annular sleeve rings and the body portion connecting webs combine to form a centering sleeve for securely maintaining the inner chamber 7 within the center of the outer chamber 1. In such an arrangement, upper sleeve ring 64 is engaged to the inner chamber 7 along the periphery of the body portion preferably along or just below the inner chamber shoulder 68. Accordingly, lower sleeve ring 66 is engaged to the periphery of the inner chamber along its lower body portion, and is provided with a closed end on its lower side onto which the bottom of the inner chamber rests. The closed end is mounted onto the hump of the inwardly arched bottom of the outer chamber while the lower support ring 62, fixedly positioned relative thereto by the connecting webs, is secured within the annular rim formed along the base of the outer chamber hump.

The upper sleeve 64 may further include uniformly spaced axially extending resilient members 70 engaged, and conformed, to the contours of the body portion periphery for optimizing the holding of the inner chamber 7 within the outer chamber 1. The resilient members 70 project from the top of the upper sleeve ring 64 and terminate in a protruding lip 72 which extends over and onto the body portion shoulder 68, thereby providing additional engaging of the inner chamber 7 to the centering sleeve. The downward urging of the resilient member lip 72 along the inner chamber 7 shoulder, as well as the inherent resistance of the sleeve rings themselves, maintains the inner chamber securely in the centering sleeve. This arrangement for mounting the centering sleeve within the outer chamber further enhances the stability of the inner chamber during transport of the two-chamber container.

Figure 10:
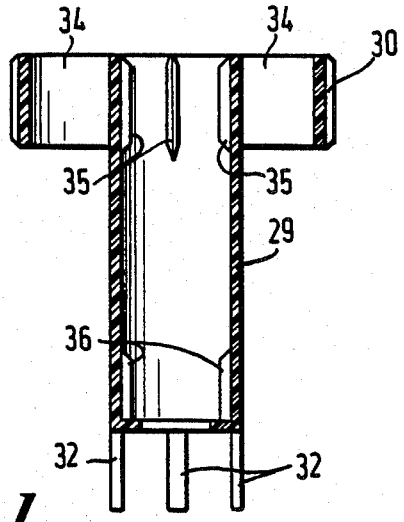
FIGS. 10 and 11 show another modified embodiment of a centering sleeve in longitudinal sectional elevation, having elastic centering lugs, FIG. 11 showing the spreading of the centering lugs in assembled condition in the outer chamber.
Figure 11:
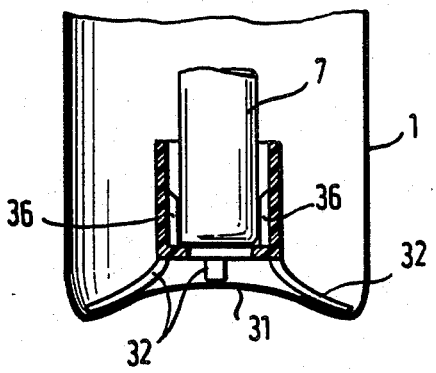

FIGS. 10 and 11 are diagrammatic presentations of another preferred embodiment of the support of the inner chamber 7 in the outer chamber 1. This embodiment is not limited to the two chamber container in accordance with the invention. Rather, this is a particularly successful and elegant structure of the support of an inner chamber within an outer chamber.

The support shown in FIGS. 10 and 11 comprises a take-up sleeve 29, preferably being made of plastic material, into which the inner chamber 7 may be pushed from the top. For centering in an outer chamber 1, the take-up sleeve 29 is provided with an upper centering ring 30 and with at least three centering lugs 32 adapted to be spread radially outwardly at its lower end facing the bottom 31 of the outer chamber 1. The centering ring 30 is connected to the take-up sleeve 29 by at least three connecting webs 34 which are uniformly spaced along the circumference. The entire centering and take-up unit is made as a one-piece injection molded member. The preferred material is polypropylene since this material guarantees elasticity of the centering lugs 32. The extension in space of the centering and take-up unit 29 is so designed that the unit may be produced by a one-piece extrusion die from which the molded member may readily be taken or drawn out of the front end.

The radial outward spreading of the centering lugs 32, upon introducing the centering and take-up unit 29 into the outer chamber 1, is promoted by an inwardly arched bottom 31 of the outer chamber 1. Another advantage of this embodiment is that the centering lugs 32 have a tendency to urge the inner chamber 7 upwardly, thereby guaranteeing the positioning of the cup-shaped receptor member with respect to the head or closure plunger of the inner chamber.

The centering and take-up unit or take-up sleeve 29 is provided in its interior at the upper and lower end with radially inwardly projecting centering ribs 35, 36 which serve to center the inner chamber 7. The ribs 35, 36 also permit the inner chamber 7 to be pushed without force into the take-up sleeve 29.

The centering and take-up unit or centering sleeve 29 preferably extends to the constricted neck portion or desired rupture site 10 in the case of an inner chamber as shown in FIGS. 1*a*, 1*b*, 3*a*, 3*b*, and 6. With an inner chamber according to FIGS. 4*a*, 4*b*, and 5*a*, 5*b*, the take-up sleeve 20 preferably extends to just below the upper end thereof, for example, to the annular shoulder 24 of FIGS. 5*a* and 5*b*. In this manner the inner chamber 7 is held safely and centered in the outer chamber 1.

If the connecting webs 34 are designed to be sufficiently rigid, the upper centering ring 30 may be dispensed with.

As explained, the centering sleeves 24', 27, and 29 described may be made of plastics. However, they may also be made of aluminum sheet or any other corrosion-resistant material.

All the features disclosed in the documents are claimed as being essential of the invention to the extent that they are novel individually or in combination with respect to the prior art.

What is claimed is:

1. An apparatus for mixing and spraying a mixture of two fluids, the apparatus comprising;

an outer chamber for containing a first fluid and having a dispensing valve for spraying;

an inner chamber, mounted within said outer chamber, for containing a second fluid, said inner chamber having a body portion and, at one end of said body portion, a rupture site and a neck portion extending from said one end of said body portion to a distal end;

a hollow interposed connecting member for said dispensing valve, said hollow interposed connecting member having an opening at a first end for providing fluid communication with the outside and a least one lateral opening at a second end for providing fluid communication with said outer chamber, said second end of said interposed connecting member extending downwardly from said dispensing valve into said outer chamber and towards said neck portion and forming a cup-shaped cavity, said hollow interposed connecting member being supported for movement between a first position when at least one of a radial and an axial clearance of 1–2 mm exists between said second end of said hollow interposed connecting member and said distal end and a second position when said second end of said hollow interposed connecting member contacts said distal end and exerts a fracture moment around and breaks said rupture site allowing the first and second fluids to mix;

an elastic sealing collar for said dispensing valve; said sealing collar supporting said hollow interposed connecting member for movement between said first position and said second position and sealing said at least one lateral opening at said second end of said hollow interposed connecting member when said hollow interposed connecting member is in said first position; and a support member fitted around and supporting said inner chamber within said outer chamber so that no lateral displacement of said inner chamber occurs when said hollow interposed connecting member is moved to said second position.

2. The apparatus of claim 1 wherein said neck portion is frangible and provides said rupture site.

3. The apparatus of claim 2 wherein said frangible neck has a constricted portion which serves as a rupture site.

4. The apparatus of claim 2 wherein said neck portion has an area of reduced wall thickness extending around its circumference and providing said rupture site.

5. The apparatus of claim 1 wherein said second end of said hollow interposed connecting member further includes a cup-shaped receptor member, said cup-shaped receptor member being disposed over and surrounding said distal end portion of said neck.

6. The apparatus of claim 1 wherein said inner chamber is a one-piece ampoule.

7. The apparatus of claim 1 wherein said support member further comprises a sleeve member for supporting said inner chamber within said outer chamber, said sleeve member and said outer chamber defining an interior annular space, said sleeve member having apertures for providing fluid communication between the interior of said sleeve member and said annular space.

8. The apparatus of claim 7 wherein said sleeve member includes at least one sleeve ring engaging the periphery of the inner chamber which is fixed by a plurality of uniformly positioned connecting webs to a support ring press fitted to the inner circumference of the outer chamber.

9. The apparatus of claim 8 wherein said sleeve member comprises an upper sleeve ring which engages the periphery of the inner chamber along its upper body portion at a location just below a shoulder of said body portion, a lower sleeve ring which engages the periphery of the inner chamber along its lower body portion, and a plurality of uniformly positioned connecting webs which extend along the entire length of the body portion from said upper sleeve ring to said lower sleeve ring, wherein said connecting webs fix said upper and lower sleeve rings to an upper support ring and a lower support ring positioned relative thereto which are press fitted to the inner circumference of the outer chamber, such that said upper and lower sleeve rings combine with said plurality of uniformly positioned connecting webs to provide a centering sleeve into which said inner chamber is mounted.

10. The apparatus of claim 9 wherein said upper sleeve ring further includes a plurality of uniformly spaced resilient members projecting from the top of said upper sleeve ring which engage and support said upper body portion of said inner chamber, said resilient members terminating in a downwardly extending lip which engages the shoulder of said inner chamber upper body portion thereby urging said body portion towards said outer chamber bottom.

11. The apparatus of claim 9 wherein said lower sleeve ring is closed at one end so that said inner chamber securely sits upon and is urged against said closed end.

12. The apparatus of claim 9 wherein said outer chamber bottom is inwardly arched into a hump so that a closed end of said lower sleeve ring is seated upon said hump and said lower support ring is fitted into, and rigidly secured by, the rim formed by said inwardly arching of said outer chamber.

13. The apparatus of claim 7 further comprising a cap member surrounding said hollow interposed connecting member, closing said outer chamber and affixed to one end of said sleeve member, said sleeve member surrounding only a portion of the length of said inner chamber.

14. The apparatus of claim 7 wherein said neck portion has a constricted area providing said rupture site, wherein said sleeve member carries a number of radially extending upwardly directed support and catch locks which engage said constricted neck portion.

15. The apparatus of claim 7 wherein the bottom of said sleeve member is provided with a plurality of flexible centering lugs engaging the bottom of said outer chamber and serving to center the bottom end of the sleeve within the container.

16. The apparatus of claim 15 wherein said sleeve member further comprises an annular ring surrounding the top end of said sleeve and is connected thereto by a plurality of web members, said annular ring being press fitted within said mouth of said outer chamber and serving to center said sleeve member.

17. An apparatus for mixing and spraying a mixture of two fluids, the apparatus comprising;

an outer chamber for containing a first fluid and having a dispensing valve for spraying;

an inner chamber, mounted within said outer chamber, for containing a second fluid, said inner chamber having a body portion with an open mouth at one end of said body portion;

a closure plunger adapted to be inserted into the open mouth of said inner chamber to form a rupture site, said closure plunger also including an attached neck portion;

a hollow interposed connecting member for said dispensing valve, said hollow interposed connecting member having an opening at a first end for providing fluid communication with the outside and at least one lateral opening at a second end for providing fluid communication with the outer chamber, said second end of said hollow interposed connecting member forming a cup-shaped cavity which extends downwardly from said dispensing valve into said outer chamber and towards said neck portion, said hollow interposed connecting member being supported for movement between a first position when at least one of a radial and an axial clearance of 1–2 mm exists between said second end of said hollow interposed connecting member and said distal end and a second position when said second end of said hollow interposed connecting member contacts said distal end and exerts a fracture moment around and breaks said rupture site allowing the first and second fluids to mix;

an elastic sealing collar for said dispensing valve supporting said hollow interposed connecting member for movement between said first position and said second position and sealing said at least one lateral opening at said second end of said hollow interposed connecting member when said hollow interposed connecting member is in said first position; and a support member fitted around and supporting said inner chamber within said outer chamber so that no lateral displacement of said inner chamber occurs when said hollow interposed connecting member is moved to said second position.

18. The apparatus of claim 17 further comprising an O-ring seated within the mouth of said inner chamber and wherein said closure plunger is provided with an annular groove for mating with said O-ring.

19. The apparatus of claim 17 wherein said mouth portion of said inner chamber is provided with a flared opening defining an annular shoulder which mates with said closure plunger.

* * * * *